US005104146A

United States Patent [19]

Schulz et al.

[11] Patent Number: 5,104,146

[45] Date of Patent: Apr. 14, 1992

[54] METHOD OF MAKING A BOOKLET, APPARATUS AND PRODUCT

[75] Inventors: Delbert H. Schulz, Warrenville; Thomas W. Franke, Glen Ellyn, both of Ill.

[73] Assignee: Wallace Computer Services, Inc, Hillside, Ill.

[21] Appl. No.: 634,088

[22] Filed: Dec. 27, 1990

[51] Int. Cl.[5] ..... B42D 15/00

[52] U.S. Cl. ..... 281/15.1; 281/43; 283/2; 283/56

[58] Field of Search ..... 281/15.1, 43; 283/2, 283/56

[56] References Cited

U.S. PATENT DOCUMENTS 1,510,110 9/1924 Schmidt ..... 281/15.1 X
1,902,567 3/1933 Martin ..... 281/43
2,354,589 7/1944 Georgi ..... 281/43
3,665,817 5/1972 Katz ..... 270/37 X

*Primary Examiner*—Paul A. Bell
*Attorney, Agent, or Firm*—Tilton, Fallon, Lungmus & Chestnut

[57] ABSTRACT

A method, apparatus and product therefrom for making a high retention direct mail promotional booklet which includes printing a continuous web on both faces thereof with first indicia suited for recipient retention and second indicia suited for promotion, slitting the webs longitudinally to provide a plurality of webs one of which is wider than the other, combining the webs with one side edge aligned while gluing the same and subjecting the webs to static electricity, thereafter folding the webs a plurality of times to provide a booklet containing at least 16 pages.

4 Claims, 3 Drawing Sheets

Fig. 4
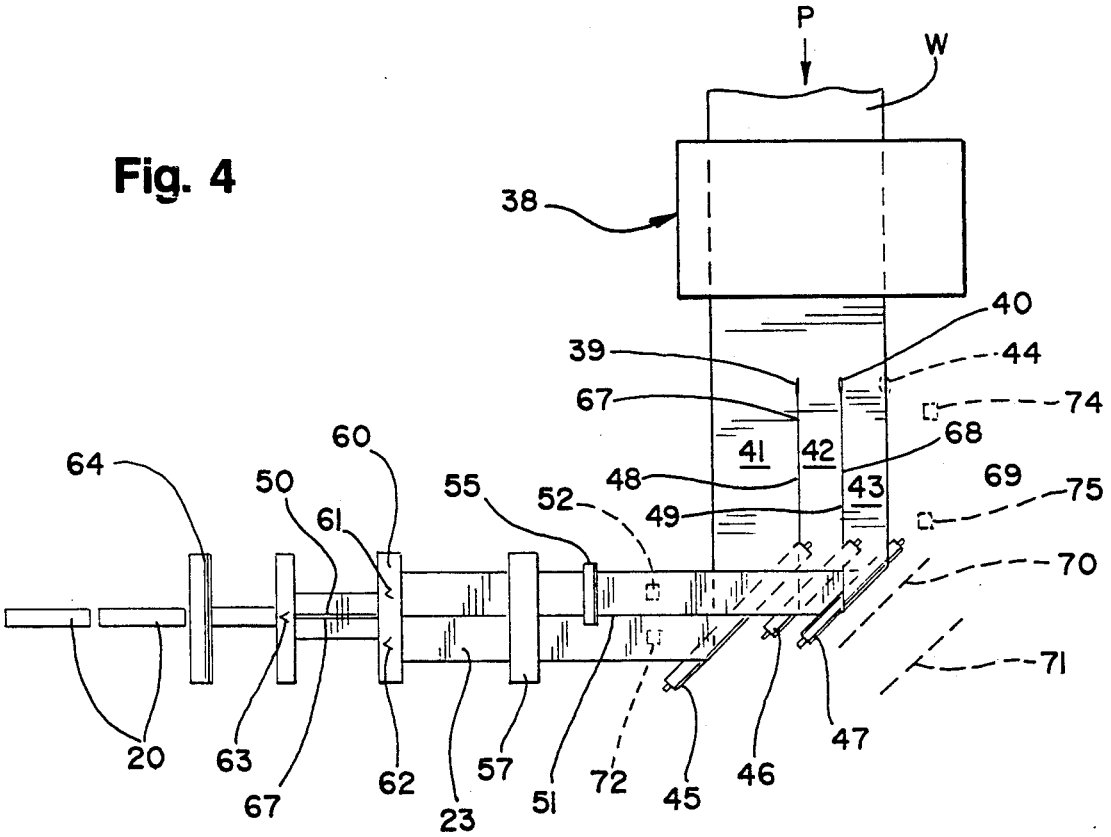
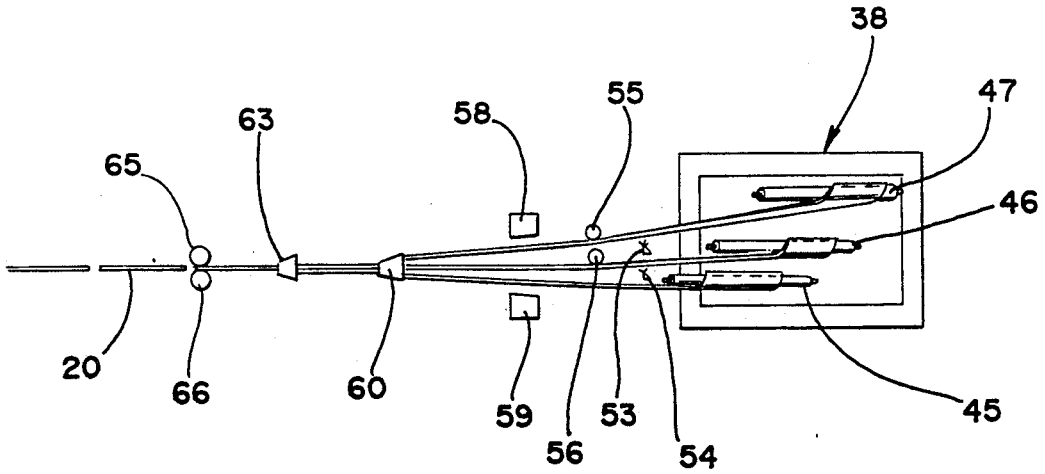
Fig. 5

Fig. 6
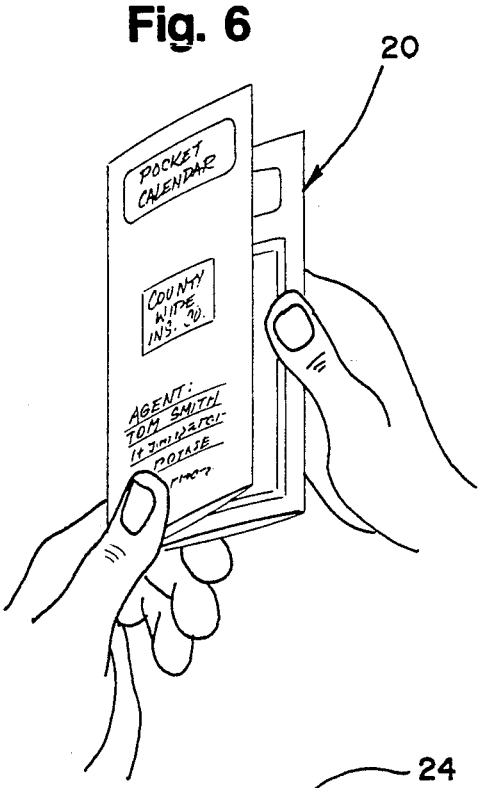
Fig. 7
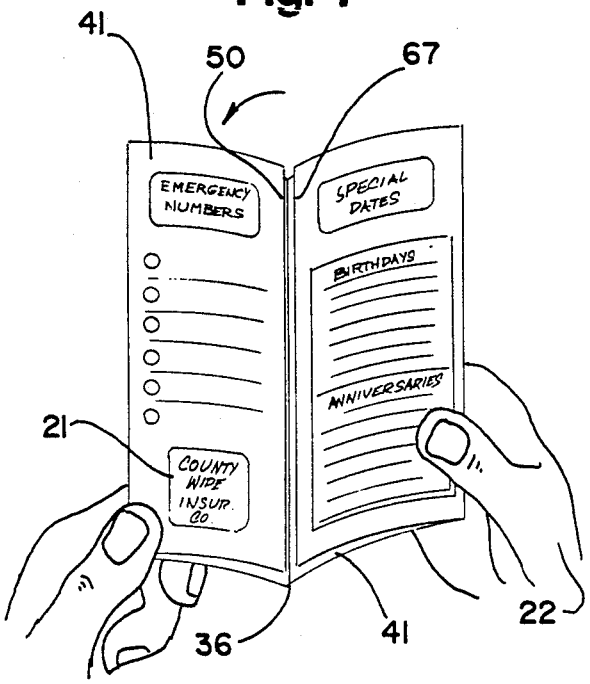
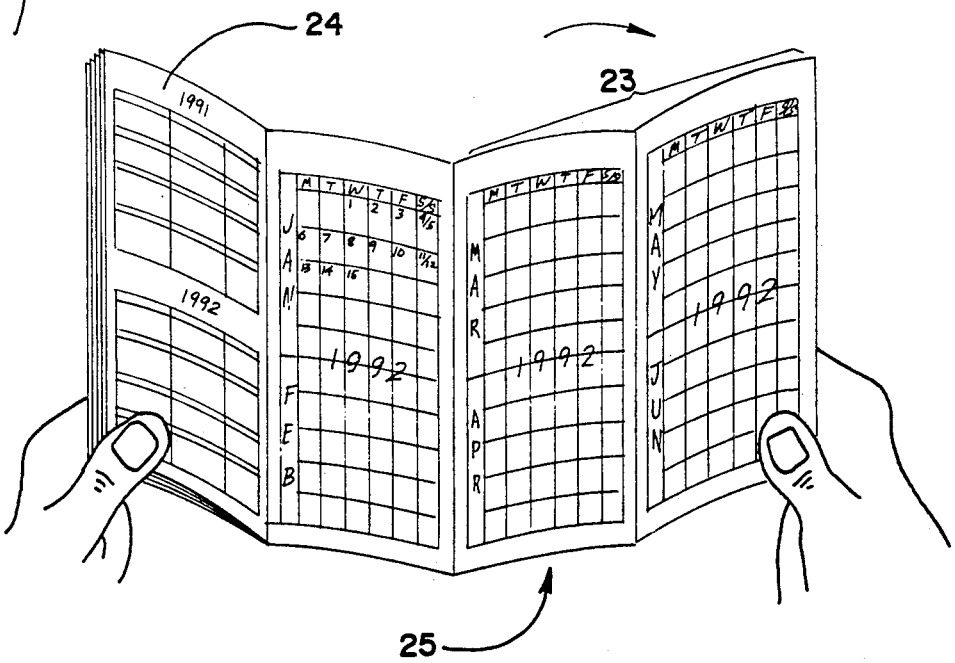
Fig. 8

METHOD OF MAKING A BOOKLET, APPARATUS AND PRODUCT

BACKGROUND AND SUMMARY OF INVENTION

This invention relates to a method of making a booklet, apparatus therefor and product therefrom, and, more particularly, to a high retention, direct mail promotional vehicle.

With increasing amounts of direct mail advertising, it has been found desirable to provide a vehicle of high retentivity. For example, a pocket calendar can insure retention by the recipient and thus continued exposure to advertising indicia associated therewith. A serious problem exists in the production of booklets having suitable retention features because of the need for a considerable number of pages. For example, even a compact personal pocket calendar requires two additional sheets and this has proved to be a problem in efficient and economic production. It will be appreciated that economy is a prerequisite in direct mail promotion and the aligning and securing a number of sheets poses production problems that could only be overcome in the past by the expenditure of considerable sums of money. In the past, for example, it has not been unusual for setup time to amount to between $5,000 and $10,000 for a particular printing. Now, according to the invention, this setup time is reduced materially because of the in-line operation provided by the invention.

According to the method of the invention, a single continuous web is printed on both faces with a combination of indicia featuring both that suited for retention and that suited for promotion. The thus-printed web is then slit longitudinally to provide at least three web portions with one of the web portions being wider than the others. The narrower web portions are superposed and longitudinally glued on the first web portion and alignment during processing is provided through the use of static electricity. Thereafter, the superposed assembly is subjected to two plowing steps to provide a compact booklet featuring a gate fold. Thus, there is provided a booklet having at least 16 and advantageously 20 or more panels or pages to achieve both the objectives of retention and promotion.

Other objects and advantages of the invention may be seen in the details of processing and construction set forth in the ensuing specification.

BRIEF DESCRIPTION OF DRAWING

The invention is explained in conjunction with the accompanying drawing, in which

FIG. 4 is a top plan view, essentially schematic, of apparatus employed in the practice of the method of the invention;

FIG. 5 is a schematic side elevational view of the apparatus of FIG. 4; and FIGS. 6–8 are a sequence of perspective views showing the opening of the inventive booklet and featuring both the retention and promotion features.

DETAILED DESCRIPTION

Figure 1:
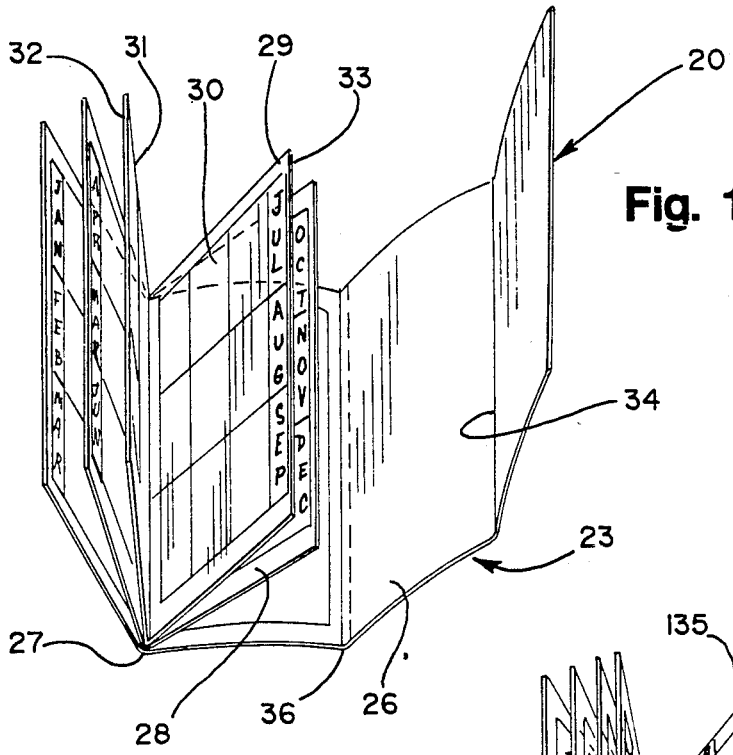
FIG. 1 is a perspective view of a partially opened 16 panel booklet embodying teachings of the invention.

Referring to the drawing and first to FIG. 1, the numeral 20 designates generally a booklet which is a high retention, direct mail piece or vehicle and which can be seen in its operative mode in FIGS. 6–8. The retention feature is illustrated as a calendar but it can alternatively feature coupons, phone numbers, restaurant guide, etc.—the point being that the bulk of the booklet carries information indicia of value to the recipient and thus serves the goal of retention. In FIG. 6, the booklet 20 is in the process of being opened to the condition of FIG. 7 after which the remaining folds can be unfolded to the panoramic view depicted in FIG. 8. This panoramic view features, in the illustration given, a calendar which provides the retention feature with at least a portion of the reverse side being equipped with the promotional indicia. Any arrangement of promotional and retention indicia may be employed in the booklet 20 of FIG. 6 and it is seen that the front cover carries both a legend relating to the retention indicia inside, viz., POCKET CALENDAR and promotional indicia relating to the entity providing the calendar.

Inside, as seen in FIG. 7, is provided retention indicia such as EMERGENCY NUMBERS and SPECIAL DATES. A minor portion may feature promotional indicia as by the logo 21. In the illustration given in FIG. 7, the holder's right hand 22 grips two thicknesses of paper which can be unfolded to the configuration 23 as shown in the right hand portion of FIG. 8. This provides a gate fold so as to reveal four panels or pages which feature a condensed two year calendar 24 and eighteen month calendar generally designated 25. In FIG. 1, the left hand pages are seen to feature an expanded calendar, viz., a pair of panels or pages for each yearly quarter.

Referring specifically to FIG. 1, the booklet 20 includes a sizeable sheet 26 of predetermined width and which has secured to the left hand portion as at 27 two additional folded sheets as at 28 and 29. Each of these folded sheets is termed a "four pager", i.e., containing four panels. For example, the innermost sheet 29 has a first panel 30 which contains spaces relating to a portion of the dates in the third yearly quarter, viz., July–September. The confronting panel 31 contains the spaces for the remaining portion of the dates in the third quarter. The reverse of the panel 31—as at 32—features spaces relating to a portion of the second quarter. The reverse of the panel 29—as at 33—features spaces relating to a portion of the fourth quarter. Therefore, it is to be appreciated that a minimum of ten pages alone are required for just the expanded calendar to make for easy entry of personal date information. But to make the booklet attractive enough for retention, the gate fold 23 has to be provided—by folding the wider sheet 26 along the fold line 34. This has presented problems in manufacture which have been overcome by the invention. The invention applies not only to the construction of FIG. 1 but also that of FIGS. 2 and 3.

Figure 2:
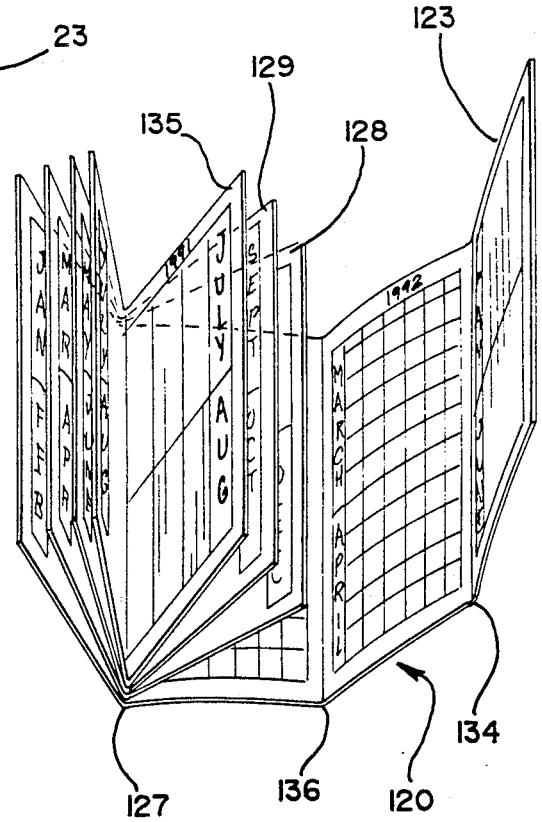
FIG. 2 is a view similar to FIG. 1 but showing a 20 panel booklet.

FIG. 2 is essentially similar to FIG. 1 but features a third folded sheet as at 135 in addition to the folded sheets 128 and 129 in the booklet generally designated 120. Here the additional superposed narrower sheet is also folded along the adhesive line 127—corresponding to the line 27 of FIG. 1. Also similar to FIG. 1 is the fold 134 in the offset configuration 123. In both cases, we provide another fold as at 36, 136 which is employed in the operations depicted in FIGS. 6 and 7.

Figure 3:
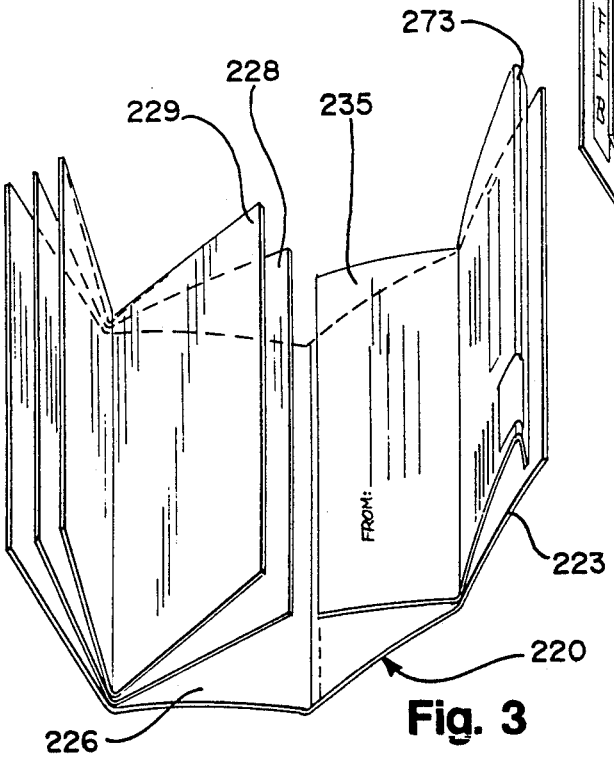
FIG. 3 is a view similar to FIG. 2 but features a return envelope so as to provide a response vehicle as part of the gate fold.

In the embodiment of FIG. 3, the additional sheet 235 is provided within the gate fold 223 of the booklet 220. All of the three embodiments are made similarly according to the method and apparatus of the invention and which can be best understood by reference to FIGS. 4 and 5.

DESCRIPTION OF METHOD AND APPARATUS

Referring now to FIG. 4, the numeral 38 designates generally a printing press which is adapted to print on both faces of a continuous web designated W being advanced along a path P. A variety of presses may be used for this purpose, an important feature and advantage being the ability to print a combination or mixture of retention and promotional indicia. FIG. 4 is essentially schematic—but it will be appreciated that the overall apparatus includes the usual frame, cross members, rolls, etc., most of which are omitted for ease of presentation and understanding.

The web W is advanced along the path P through slitters as at 39 and 40 so as to develop three independent webs, i.e., a first web portion 41, a second web portion 42 and a third web portion 43. Where the booklets 120 or 220 of FIGS. 2 and 3 are to be manufactured, a wider web W is employed and an additional slitter is installed in the dotted line position designated 44.

The next step in the operation of the apparatus to perform the inventive method is to superpose the narrower web portions 42 and 43 on the wider first web portion 41. This is advantageously achieved through a series of turning bars as at 45, 46 and 47—similar to the fashion shown in U.S. Pat. No. 3,665,817.

In the illustrated embodiment, the turning bars are arranged so as to generally align the first side edge 48 of the third web portion 42 and the first side edge 49 of the second web portion 43 with one free edge 50 of the first web portion 41. Advantageously, the widths of the second and third web portions 42, 43 are approximately one-half the width of the first web portion 41—as can be appreciated from the showing at 51 in FIG. 4.

Incident to the superposing of the second and third web portions 42, 43 on the first web portion 41, glue or adhesive is applied at the station 52 by means of nozzles 53 and 54 (see FIG. 5). Thereafter, the webs pass under guide rollers 55, 56 and are subjected to static electricity by means of an electrical unit 57 which includes upper and lower bars 58 and 59 (compare FIGS. 4 and 5). Static electricity has been used in the processing of business forms in the past but, to the best of our knowledge, never in conjunction with aligning superposed web portions on a wider sheet for the development of a multi-page booklet of the combined retention/promotional features of this invention.

After the superposed webs have passed through the static electricity providing means 57, they enter into a first folder 60 which features a pair of plows 61 and 62 to develop continuous longitudinal folds in both the superposed web portions as at 27 in FIG. 1 and in the exposed overlap 23 of the first web portion 41 as at 34—again see FIG. 1.

Thereafter, the partially formed booklet is subjected to a further plowing operation by means of the plow 63 which generates the fold 36—see FIG. 1.

Finally, the now continuous booklet stream is subjected to transverse cutting by means of cutting apparatus 64 embodying a knife roll 65 and an anvil roll 66 (compare FIGS. 4 and 5) and which results in a series of discrete booklets 20.

SUMMARY OF OPERATION

For producing a high retention direct mail promotional booklet 20, a web W (see FIG. 4) of predetermined width is advanced along a path P. In accordance with common parlance in the continuous web art, the term "longitudinal" applies to the length of the web and therefore, the path P is longitudinal even though it includes a right angle turn.

The web is first printed on both faces thereof with first indicia suited for recipient retention and second indicia suited for promotion. Here it should be appreciated that in some instances one or both faces of the web may have either all of one form of indicia or the other, or a combination thereof.

After printing, the web 38 is slit longitudinally along at least two parallel lines as by the slitters 39 and 40 which are positioned inward of one free edge 50 of the web so as to provide a first web portion 41, and narrower web portions 42 and 43. The second and third web portions 42, 43 each have a width approximately one-half the width of the first web portion 41.

Next we perform a combining operation which includes both gluing and web shifting. More particularly, the second and third web portions 42, 43 are superposed on the first web portion 41. Each of the second and third web portions, i.e., the narrower portions, 42, 43 have first side edges 48, 49 respectively and these are aligned with the first free edge 50 of the wider first web portion 41. Incident to this superposition and as can be appreciated from FIG. 5, we apply lines of adhesive to some of the web portions to secure the same along a line which is approximately one-quarter of the width of the first web portion 41 in from the one free edge 50 and which also is approximately one-half of the width of the second and third web portions 42, 43. This longitudinally extending line corresponds to the fold 27 previously referred to in connection with FIG. 1.

Resulting from the superposition just described is an exposed overlap portion 23 in the first web portion 41. This also can be appreciated from a consideration of FIGS. 1 and 8.

Next, the superposed web portions 41–43 are subjected to static electricity as at the position designated 57 in FIG. 4 after which longitudinal folding is performed.

The three superposed webs 41–43 are folded along the longitudinal center line of the narrower web portions 42, 43 as by the plow 61 to develope the fold designated 27 in FIG. 1. Simultaneously, the overlap portion 23 is folded along its longitudinal center line by the plow 62 to develop the fold designated 34 in FIG. 1. This results essentially in the configuration depicted in FIG. 7 where it will be seen that the one or first free edge 50 of the wider web portion 41 is closely adjacent to the second free edge portion 67 also of the first web portion 41. Both free or side edge portions of the narrower webs 42, 43 are generally aligned with the first free edge portion 50.

In other words, all of the first side edges 48–50 and the second side edges 68, 69 of the second and third web portions 42, 43 are generally aligned and face the second side edge 67 of the first web portion 41.

Thereafter, the folded construction resulting from the folding at 60 is subjected to another longitudinal fold at 63 to develop the fold 36 which lies between the confronting side edges 50, 67 of the first web portion 41—see FIG. 7.

There is now a continuous stream of booklets and we transversely sever the stream as at 64 to provide a series of individual booklets 20.

FIG. 2 Embodiment

As pointed out previously, the embodiment of FIG. 2 differs essentially from that of FIG. 1 in providing an additional narrower web portion—ultimately becoming the "four pager" or sheet 135. This is developed by slitting a wider web as at 44 in the upper right hand portion of FIG. 4. Advantageously, the fourth web portion (not shown) provided thereby is of the same width of the narrower web portions 42, 43. This is superposed on the web portion 43 by a turning bar located in the dotted line position designated 70 in FIG. 4. Subsequently adhesive is applied at station 52 and the folding proceeds as described in conjunction with the embodiment of FIG. 1.

FIG. 3 Embodiment

Again, we slit a wider web as at 44 to provide a first web portion but in this case the fourth web may have a width somewhat greater than that of the second and third web portions 42, 43—in order to provide a return envelope, for example. This can be appreciated from a consideration of FIG. 3 where the sheet 226 corresponding to the first web portion 41 is substantially the same as it was in FIG. 1. We provide narrower sheets as at 228 and 229 corresponding to the sheets 28 and 29 of FIG. 1. However, the additional sheet 235 is now superposed on the overlap portion 23 as by a turning bar in the position designated 71 in FIG. 4. An additional gluing station 72 (still referring to FIG. 4) is provided so as to secure the fourth web portion 235 along generally the longitudinal center line of the overlap portion 223.

In the instance where the fourth web portion 235 is superposed on the overlapped portion 223 to serve as a return envelope, we make the fourth web portion of a width slightly greater than that of the second and third web portions 228, 229 (alternatively slightly greater in width than one-half of the outer web portion 226) so as to provide an envelope flap as at 273. Prior to developing the flap 273, the fourth web portion 235 is advantageously equipped with remoistenable adhesive as at the position designated 74 in FIG. 4 and thereafter folded in the position designated 75.

Thereafter folding and transverse severing occurs and by changing the knife and anvil rolls 65, 66 we provide vertical height trim size options of 4-7/16", 5⅜", 7¼" or 11" with the nominal width of the finished booklet of 3⅝".

In some instances, we find it advantageous to introduce a line of longitudinal perforation corresponding to the fold line 36 for the removal of the gate fold which may itself be a business reply envelope.

Through the practice of the invention, pieces are produced in-line, from roll to finished product.

While in the foregoing specification a detailed description of the invention has been set down for the purpose of illustration, many variations in the details hereingiven may be made by those skilled in the art without departing from the spirit and scope of the invention.

I claim:

1. A high retention, direct mail promotional booklet comprising a first generally rectangular sheet having a width providing first and second side edges, at least two narrower sheets superposed on said first sheet, each of said narrower sheets also having widths providing first and second side edges, the first side edges of said first and narrower sheets being generally aligned, the second side edges of said narrower sheets being approximately aligned with a first longitudinally extending line midway between the first and second side edges of said first sheet and thereby providing an overlap portion in said first sheet between said first longitudinally extending line and said first sheet second side edge, said first and narrower sheets being adhesively secured together along a second longitudinally extending line midway between the narrower sheets first and second side edges, said first and narrower sheets being folded along said second longitudinally extending line with the narrower sheets positioned inward of the folded first sheet, said first sheet being folded on itself along a third longitudinally extending line positioned midway of the width of said overlap portion to provide a gate fold and with said first sheet second side edge being positioned adjacent the second side edges of said narrower sheets, said first sheet being folded on itself along said first longitudinally extending line with the folded narrower sheets and the folded overlap portion positioned inward of the thus folded first sheet, each of said sheets having printed indicia on both faces thereof, said printed indicia including both promotional information and information of a non-promotional nature which tends to make the booklet owner retain the same, said booklet in folded condition having a height in the range of about 4-7/16" to about 11" and a width of about 3⅝".

2. The booklet of claim 1 in which a third narrower sheet substantially identical to said two narrower sheets is superposed on said two narrower sheets and adhesively secured thereto along said second longitudinally extending line and folded similarly to said two narrower sheets to provide a booklet having at least 20 panels.

3. The booklet of claim 1 in which a third narrower sheet is superposed on said first sheet overlap portion and adhesively secured along said third longitudinally extending line and folded similarly to said overlap portion.

4. The booklet of claim 3 in which said third narrower sheet is initially folded on itself to provide a return envelope flap.

* * * * *